US005836474A

United States Patent [19]

Wessberg

[11] Patent Number: 5,836,474

[45] Date of Patent: Nov. 17, 1998

[54] STORAGE MEANS SPECIALLY INTENDED FOR MEDICAMENTS

[75] Inventor: Göran Wessberg, Upsala, Sweden

[73] Assignee: NovaTelligence AB, Ronneby, Sweden

[21] Appl. No.: 649,711

[22] PCT Filed: Nov. 28, 1994

[86] PCT No.: PCT/SE94/01137

§ 371 Date: May 24, 1996

§ 102(e) Date: May 24, 1996

[87] PCT Pub. No.: WO95/14456

PCT Pub. Date: Jun. 1, 1995

[30] Foreign Application Priority Data

Nov. 26, 1993 [SE] Sweden ..... 9303919

[51] Int. Cl.[6] ..... G07F 11/66

[52] U.S. Cl. ..... 221/25; 221/2

[58] Field of Search ..... 221/2, 3, 25, 26, 221/30, 31, 7, 9, 15; 206/529, 531

[56] References Cited

U.S. PATENT DOCUMENTS

| | | | |
|---|---|---|---|
| 4,074,806 | 2/1978 | Ardito | 206/531 |
| 4,158,411 | 6/1979 | Hall et al. | 206/531 |
| 4,169,531 | 10/1979 | Wood | 206/531 |
| 5,181,189 | 1/1993 | Hafner | 221/2 |

FOREIGN PATENT DOCUMENTS

| | | |
|---|---|---|
| 0129785 | 1/1985 | European Pat. Off. . |
| 0172638 | 2/1986 | European Pat. Off. . |
| 0191168 | 8/1986 | European Pat. Off. . |
| 463348 | 11/1990 | Sweden . |
| 86/06048 | 10/1986 | WIPO . |
| 91/05310 | 4/1991 | WIPO . |
| 91/05311 | 4/1991 | WIPO . |
| 94/06088 | 3/1994 | WIPO . |

*Primary Examiner*—Kenneth Noland
*Attorney, Agent, or Firm*—Birch, Stewart, Kolasch & Birch, LLP

[57] ABSTRACT

The invention relates to a medicament storage device which includes a storage plate having a plurality of storage spaces for storing quantities, such as medicament dosages and a base unit which has a memory and an alarm function. The device is characterized in that the openings of respective storage spaces are provided with a closure means in the form of a long and a short flap which overlap one another and which are either spring mounted or consist of elastic material. The flap overlap regions include indicating means which illustrate in which direction passage has occured through the opening and/or with detecting means which produce a signal relating to the direction of the last passage through the opening.

10 Claims, 6 Drawing Sheets

STORAGE MEANS SPECIALLY INTENDED FOR MEDICAMENTS

BACKGROUND OF THE INVENTION

1. Field of the Invention

The present invention relates to a storage device, and particularly to a device for storing medicaments.

2. Description of the Background Art

The earliest type of devices intended to assist in controlling the intake of medicines have the form of dosage packages that include different compartments corresponding to the daily dosages of medicine, often covering one week. These packages can be combined with some form of alarm clock, although they naturally give no control over whether a pill has been taken, and if a pill was taken, at what time it was taken.

Also known to the art are medicine storage devices which are connected to a memory unit which produces an acoustic and/or light alarm signal when it is time to take the next dose. The simplest of these devices includes only one or possibly more pill storage boxes and an alarm unit. The alarm device is often supplemented with a so-called acknowledgement button which is depressed after having taken the relevant dose. Such devices are highly unsatisfactory with regard to the possibility of checking whether a dose has been taken and if so when the dosage was taken. The prior art devices typically comprise no means which would prevent a double dose being taken, i.e. a person taking his/her medication several times on one and the same medicating occasion.

For example, EP 172 638 teaches such a storage device which includes several different pill and/or capsule compartments and an alarm device which for each compartment produces a signal at a predetermined interval when it is time to take respective pills. Lamps arranged at each compartment indicate the compartment from which a pill shall be taken, and the number of ignited lamps shows how many pills shall be taken. An electric contact provided in the lid of the compartment detects when the lid is opened and thus when the dosage has been taken, otherwise the alarm signal is repeated at regular intervals until the medicine has been taken. One drawback with this arrangement, however, is that there is no safe check that the medicine has actually been taken or just how many pills have been taken. The signal is cut-off when the lid is opened and the device is filled with a full week's dosage on each filling occasion.

Also known to the art are storage devices combined with a programmable memory unit, which function to advance a dosage each time that medication shall be taken. For example, WO 91/05310 and WO 91/05311 teach medicine storage devices which include storage spaces or compartments for a plurality of different medicaments and advances a relevant dosage with the aid of a computerized control unit. WO 86/06048 teaches a storage device which comprises a magazine having a large number of pre-filled medicament containers whose contents are adapted to each particular medicating occasion. The device also includes a memory unit which produces a signal and feeds a medicament container at predetermined times. This device is complicated and can only be filled with difficulty and does not allow different types of medicament, or medicine, to be taken in an order different to that ordained. These devices are large in size and expensive, and are not suited for individual use or for carriage on one's person.

Storage devices which include blister-sealed packs or packages comparable therewith are also known to the art.

These packs also include a memory and an alarm part and/or a registering part which registers when a dose is taken. For example; EP 0 398 996 describes a storage device of this kind which includes a sheet provided with holes which corresponds to the positions of the alveoli in a blister-sealed pack. Each hole has adjacent thereto electrical contact surfaces which are connected so that each alternate surface is connected to a common electrical conductor and each other alternate surface is connected to a specific conductor for each pill or tablet location. When a pill is pressed out, the aluminium foil sheet surrounding the tablet location is broken-up and makes an electric contact between the different contact surfaces such as to cause a signal to pass through the memory unit in acknowledgement of the dosage being taken. EP 0 191 168 teaches a similar device which includes a perforated sheet on which a blister pack is intended to be placed. Each hole accommodates a sensor which sends a signal to the memory unit when a pill, tablet or the like passes the hole. EP 129 785 teaches a blister pack which includes electrical conductors that extend over those regions of the foil sheet that are intended to be depressed and broken when removing a pill, tablet or the like.

Storage devices that are combined with blister packs have the limitation of being useable for only one type of medicament. It is also often necessary to use a specially manufactured blister pack, which further limits the use of such combinations.

SUMMARY OF THE INVENTION

Accordingly, the object of the present invention is to provide a storage device in the introduction with which substantially eliminates the drawbacks of earlier known devices and which will acknowledge the intake of a dosage and prevent the person concerned taking a double dose. It is another object that the present invention can be used as a simple medication carrier, or for a more complicated medication program, and which can be carried easily on a person and which is inexpensive in manufacture and has only a few movable parts.

The inventive principle will be evident from FIG. 1*a*, which shows the different stages of the passage of a body A through an opening O which is covered by two mutually overlapping and resilient or otherwise springy flaps of mutually different size. As the body passes through a hole, the flaps are pressed to one side, wherein the shorter flap K is released first and is able to spring back to its hole closing position. When the body A has passed completely through the opening and beyond the longer flap L, this longer flap will also spring back until stopped by the flap K. If a body A is passed through the hole in the other direction, the flaps will bend away and spring back, but with the flaps now in reversed positions, as shown in FIG. 1*b*.

This phenomenon can be utilized to show the direction in which a body A has passed through the opening O. According to a first method, this is effected by providing an indicating means on the mutually overlapping parts of the flaps K and L, for instance a color marking or some other marking. According to a second method, this directional indication is effected by arranging electrical contact surfaces on the overlapping parts of the flaps and extending conductors from said surfaces to signalling means (lamps, acoustics) and/or a data processing means, such as a microprocessor. Naturally, these two methods can be combined.

Particularly when several openings are concerned, closed spaces having a movable wall or bottom opposing the opening can be provided on one side of the openings. This enables objects, for instance pills, to be pressed in through the openings and for it to be readily ascertained which spaces accommodate a pill.

The use of such flap-equipped openings in medicament storage devices enables those spaces, or compartments, which are full or empty to be readily marked with color markings or text. By extending separate electrical conductors from the different contact surfaces on each of the flaps to a base unit having a common memory and data processing unit, it is possible to register if a medicament has been taken and, if so, when the medicament has been taken. With the aid of the data processing unit, it is beneficially possible to change the time and/or the dosage for the next medicating occasion, e.g. in the event that a medicament intake has been delayed or has taken place at an earlier time.

A device of this kind eliminates the drawbacks associated with known medicament storage devices, for instance with the device according to EP 172 638. An indication that a pill has been taken takes place when the pill concerned passes through the lid flaps, and each compartment accommodates solely one pill or one medicament dosage for that medicating occasion. Mistakes are therefore practically impossible, even in the case of older or confused patients.

In its simplest form, the inventive device is comprised solely of a base plate having a number of rows of punched openings. The plate is provided on one side thereof, or on both sides thereof, with one or both of two foil sheets which have punched therein long and short mutually opposing flaps which partially overlap one another and cover said openings. The spaces beneath the openings are produced by mounting a pitted elastomeric membrane on the base plate or the foil sheet, with the pits or alveoli located beneath each opening, such as to form the spaces or cavities. The cavities can be emptied by pressing on the outside thereof in a direction towards the opening and the flaps, with the finger. The device can be recharged with a day's requirement of medicament for instance, therewith enabling the device to be used several times. Color markings indicate full cavities and no base unit is used.

According to another embodiment, the base plate may have the form of a circuit board from which electric conductors lead to the flaps at each opening. Alternatively, the conductors can be mounted on one or both of the foil sheets. One foil sheet may be made of metal and will then form a common conductor or earth contact for all openings in the plate. The metal foil sheet will preferably include the short flaps. In the case of this embodiment, the base plate, together with its flaps and conductor, forms part of a medicament storage device which includes a common base unit for storing and processing input and output data. According to an alternative embodiment, the spaces may be comprised of a number of cells having movable bottoms which can be displaced towards respective openings by means of spring-tensioned ejection buttons.

According to one variant of the invention, a typical blister pack with an unbroken seal is mounted beneath or on top of the base plate with the side that includes the seal openings facing towards the base plate, and the pills or tablets are removed through the openings in the plate. The aforesaid membrane or cell structure is then optionally placed beneath the blister pack and the tablets, pills or the like are removed in the same manner as that earlier described. However, one serious risk with this variant is that the metal foil sheet may cause short circuits and error signals to occur, after a pill has been pressed out. This risk can be avoided, by first removing the metal foil sheet or by using a covering foil sheet which is not electrically conductive.

In the case of another embodiment, the device lacks a base plate and includes only two foil sheets in which flaps are punched, wherein one foil sheet includes separate conductors which lead from electrical contact surfaces on each flap to the base unit. The other foil sheet may be made of metal or coated with metal, so as to be electrically conductive. The combined foil sheets can be surrounded by a supporting frame, or may also be supported by a removable protective casing provided with grooves for receiving the edges of the foil sheets. This form can be made combinable with a large number of existing medication devices which include a blister pack or the like, so as to establish safely and simply when a pill has passed through a given opening and the direction in which the tablet has passed.

BRIEF DESCRIPTION OF THE DRAWINGS

The invention will now be described in more detail with reference to exemplifying, non-limiting embodiments thereof and also with reference to the accompanying drawings, in which.

DETAILED DESCRIPTION OF THE PREFERRED EMBODIMENTS

Figure 1A:
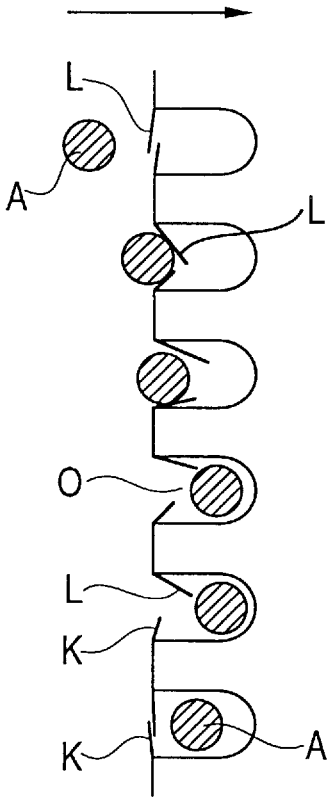
FIGS. 1*a* and 1*b* illustrate principally the passage of a body through an opening provided in an inventive storage device.
Figure 1B:
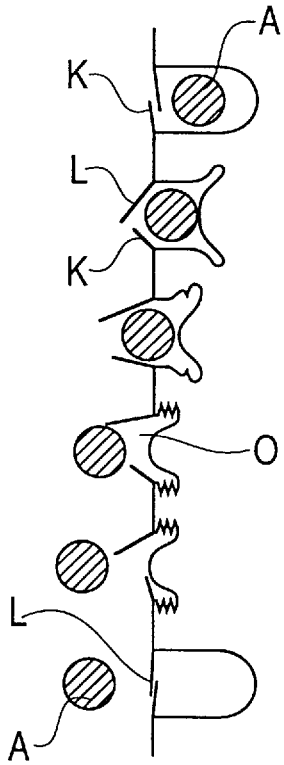
Figure 2:
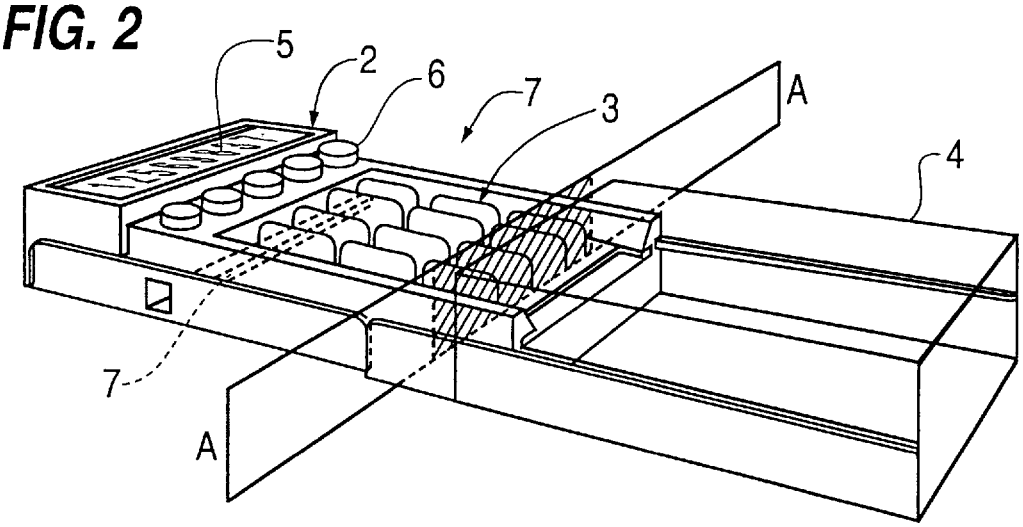
FIG. 2 illustrates an inventive storage device which includes a storage plate and a transparent casing.

FIG. 2 illustrates an inventive storage device 1 which includes a base unit 2 having a memory and an alarm signal function, and means for attaching a storage plate 3. The device includes a removable protective casing or lid 4. The base unit includes a LCD-window or light diode window 5, from which programming of the medication times and possibly also the times at which medicament is taken can be read, and also a number of buttons or keys 6 with which a medication program can be keyed-in and programs and possible events can be checked. The attachment or fastener means may have the form of a storage plate insertion opening 7 provided with electrical connection contacts (not shown) for coaction with electrical conductors, as described below.

Figure 3:
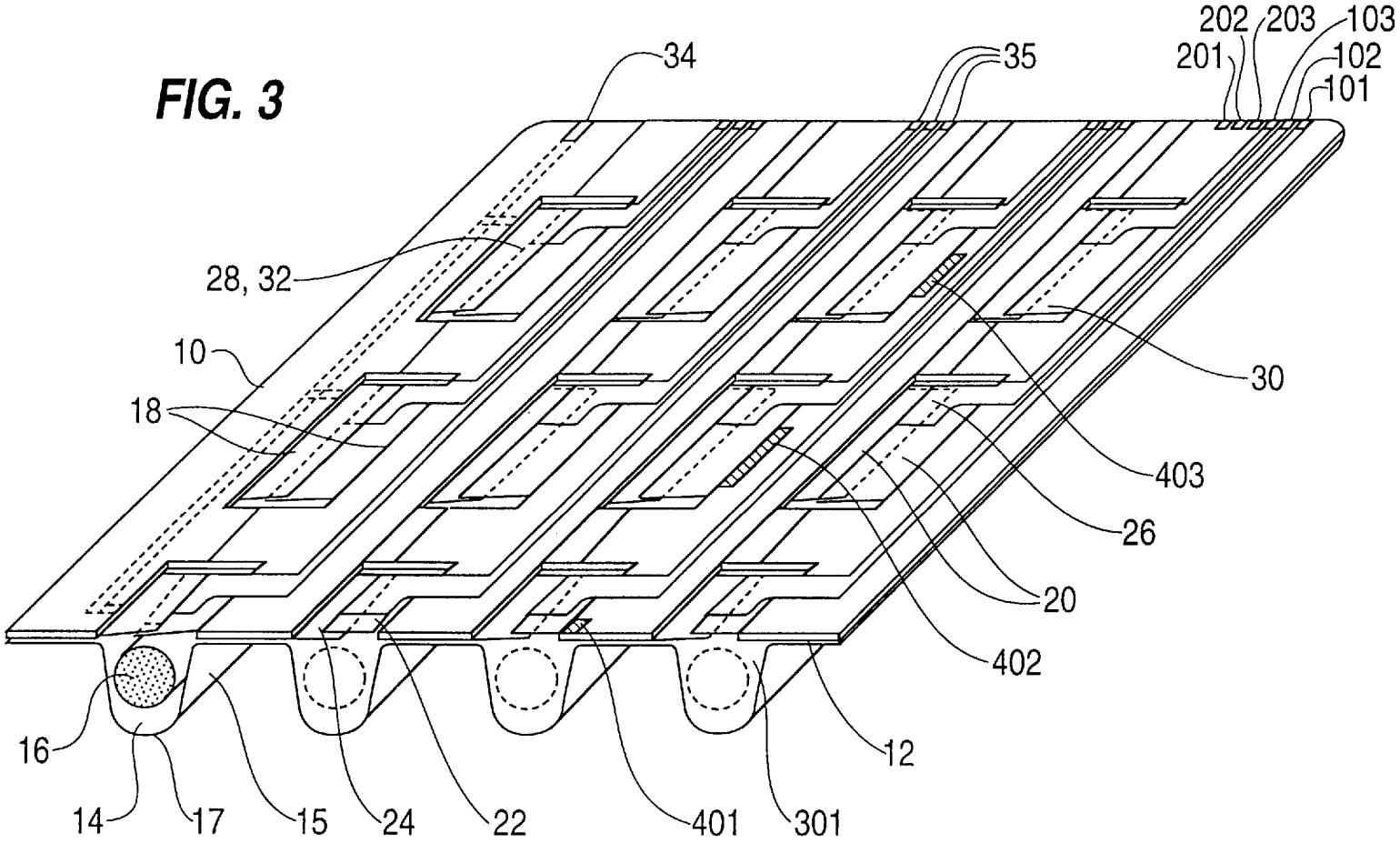
FIG. 3 is a perspective sectioned view of the storage plate shown in FIG. 2, said view being taken on the line A—A.

FIG. 3 illustrates a storage plate which includes a base plate 10 and a bottom plate 12 having formed therein pits or alveoli which include walls 15 and a bottom 17 each enclosing an individual space 14 which is intended to accommodate a medicament dose 16. The dose may consist in one or more units, such as tablets, pills or capsules of one or different types. The base plate 10 is provided above each alveolar with a hole 18 through which the dose is intended to pass. At least that part of the bottom plate 12 which forms the walls 15 and the bottom 17 of the alveoli is comprised of an elastomeric membrane. The medicament dosage can be pressed-up through the hole 18 in the same manner as in a typical blister pack, by pressing against the bottom 17 of respective alveoli.

Each hole 18 is covered by a lid 20 comprised of a long lid flap 22 and a short lid flap 24 made of a resilient or springy material. The short flap 24 is made either of a non-electrically conductive material and will then have a first electrical contact surface 28 on the underside thereof and a second electrical contact surface 32 on the upper side thereof, or is made of an electrically conductive material, wherein the flap surfaces form the first contact surfaces 28, 32. A first contact surface 26 is provided on the upper side of the long flap 22 and a second contact surface 30 is provided on the underside thereof. The two contact surfaces 28 and 32 are both connected to a conductor 34 incoming from the base unit 2. This conductor is connected to all short flaps 24. An individual conductor 101, 102, etc. extends from each of the long flaps 22, from a respective first contact surface 26 thereon to the base unit 2, and a second individual conductor 201, 202, etc. extends to the base unit 2 from the second contact surface 30 on respective long flaps. Respective conductors leading from the first and the second contact surfaces on the flaps 22, 24 include electrical contacts 35 located adjacent the edge of the storage plate 3 and intended for connection to the base unit 2. This enables the base unit to detect, in a known manner, the position or status of the lid flaps over each of the spaces 301, 302 etc. defined by the alveoli 14.

The light emitting diode window or LCD-window 5 on the base unit 2, or some other form of marking means, can be used to mark the space 301, 302 etc. that is next in line to deliver the next medicament dosage 16. A particular advantage is afforded when light emitting diodes or LCD-windows 401, 402 etc. are provided at each space 301, 302 etc. These diodes or windows can be supplied with current from the base unit 2, via the "inward"-signalling conductors 101, 102 etc., possibly in combination with the corresponding "outward"-signalling conduits 201, 202 etc.

Figure 4:
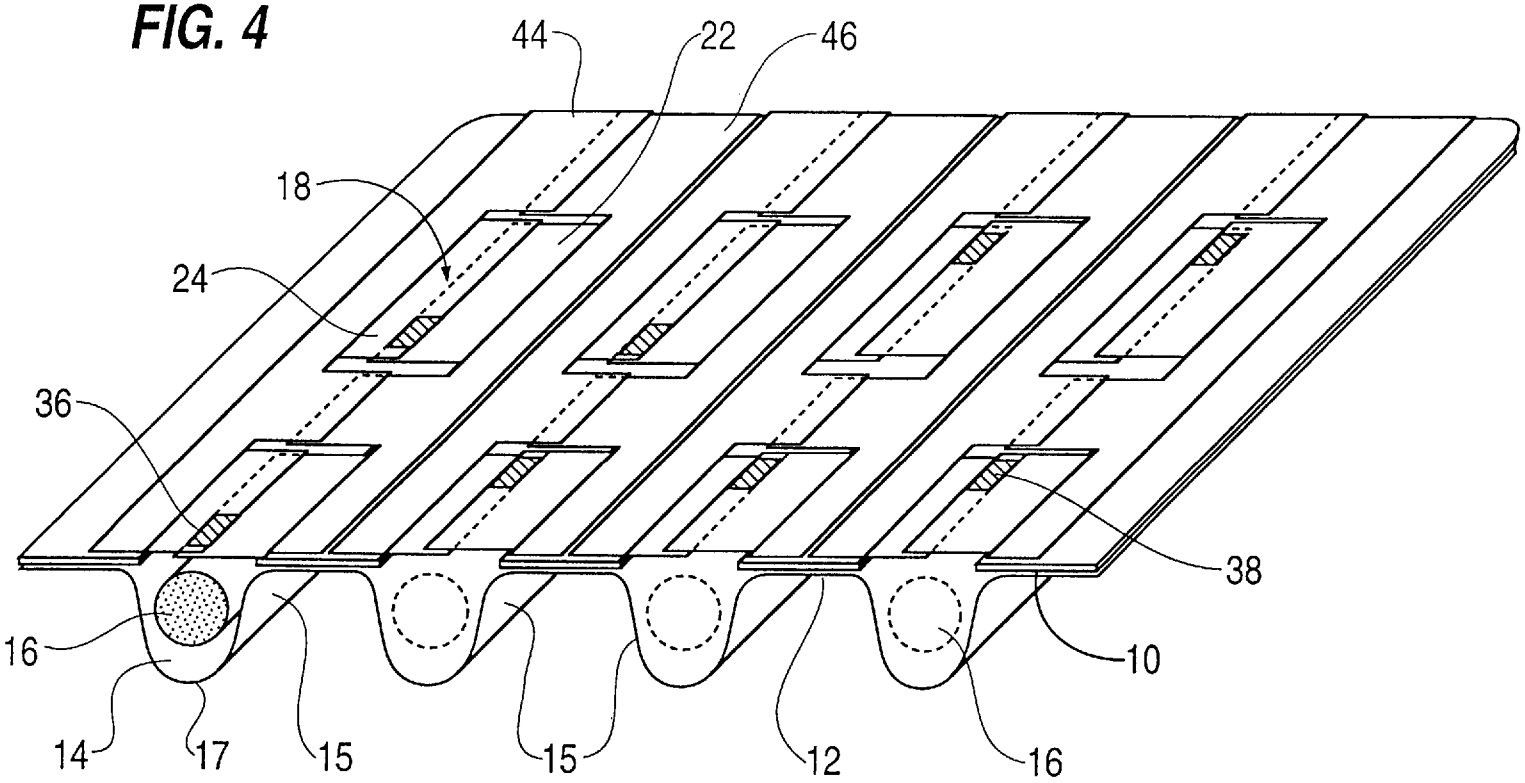
FIG. 4 is a perspective sectioned view of an alternative form of the storage plate shown in FIG. 2, said view being taken on the line A—A.

The outer surface of the overlapping region of the short flap 24 may be provided with a color marking and/or a sign marking 36, which depicts an "inward"-position, while the long flap 22 may be provided on the outer surface of its overlapping region with a color marking and/or sign marking 38 which depicts an "outward"-position. This enables those spaces 301, 302 etc. that are filled with medicament to be ascertained visually. This is illustrated in FIG. 4 in particular, which illustrates a storage plate that has no electrical contacts, although the arrangement can also be used on the plate shown in FIG. 3.

Figure 5:
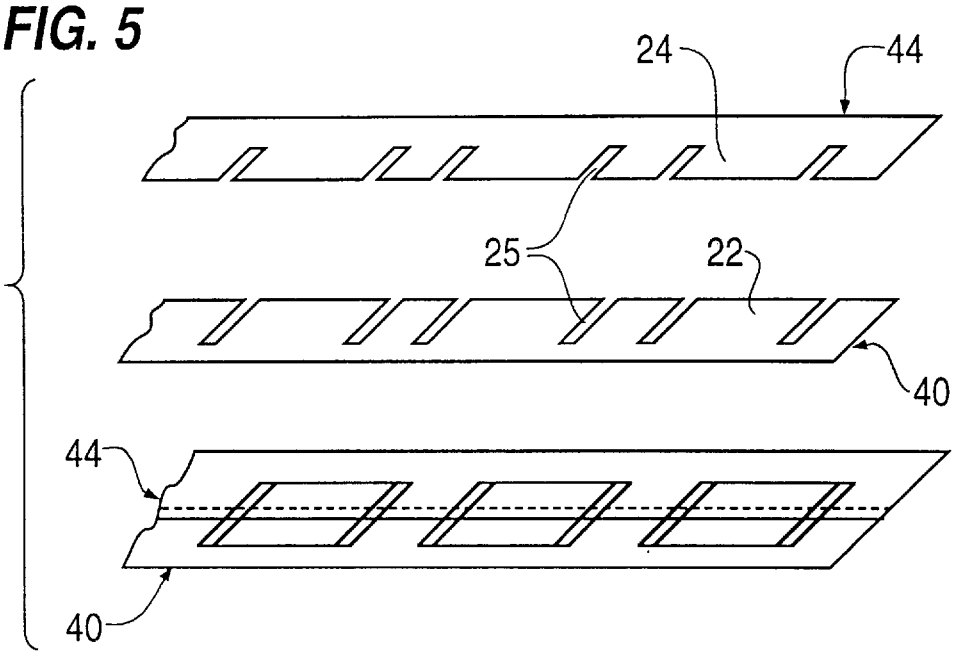
FIG. 5 is an exploded view of part of a storage plate during assembly.
Figure 8:
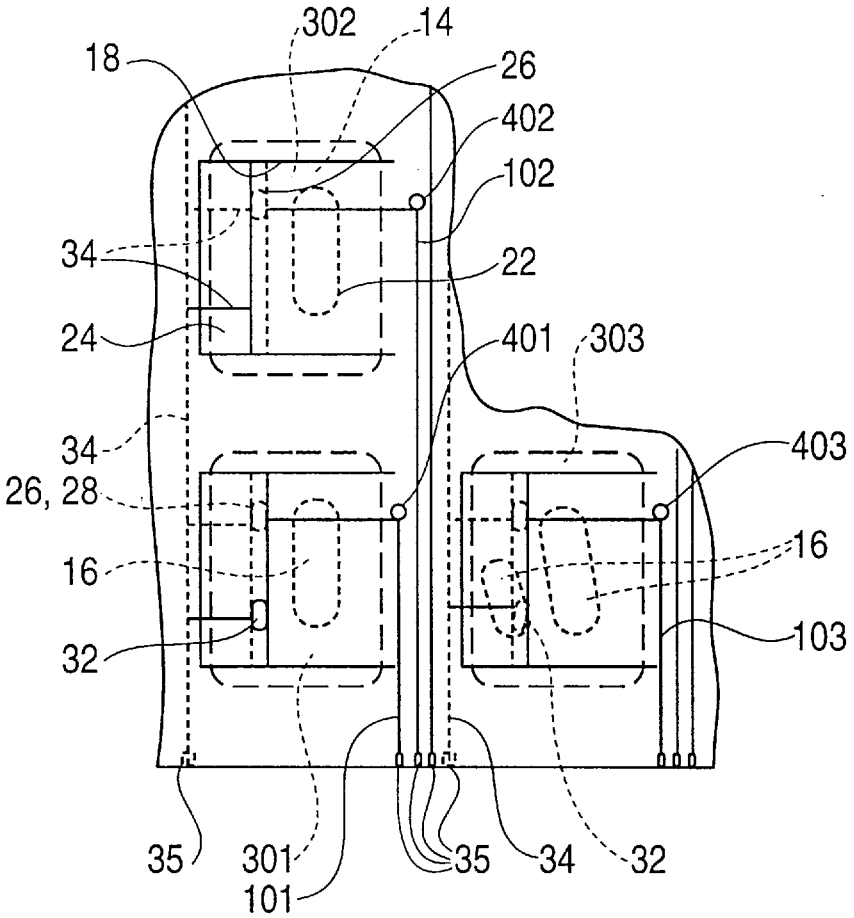
FIG. 8 is a part view of FIG. 3 and illustrates openings and flaps.

The lid flaps 22 and 24 may have the form of separate tongues that are attached to the base plate 10 or may have the form of continuous rows of tongues as illustrated in FIG. 5, which illustrates foil strips 40, 44 in which slots 25 have been punched to leave intermediate long and short tongues 22 and 24 respectively, strips 40, 44 being positioned so as to overlap one another.

Figure 6:
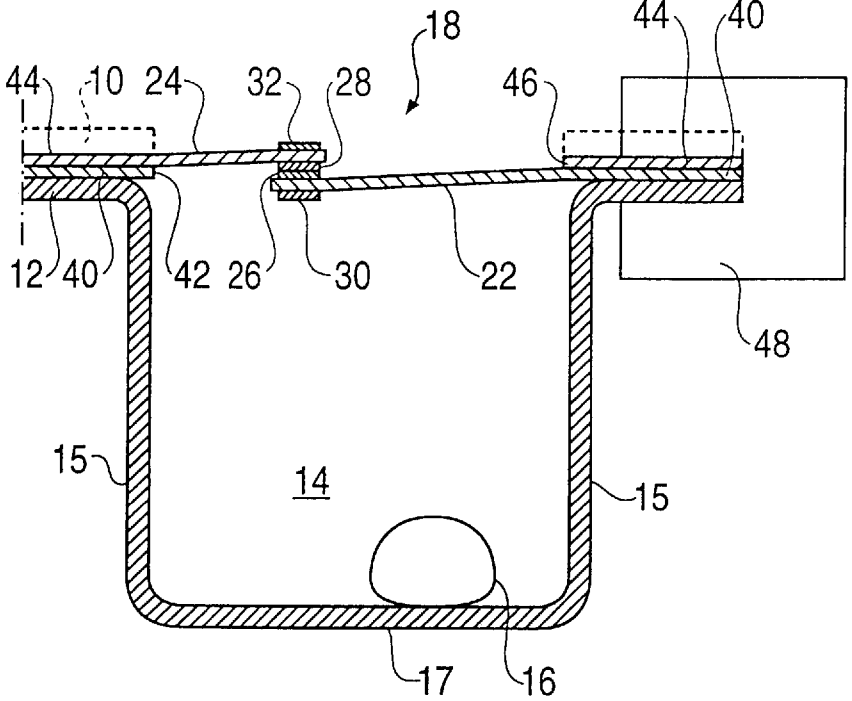
FIG. 6 is an enlarged view of part of the storage plate shown in FIG. 3.

According to one particularly beneficial embodiment, the device includes a first foil sheet 40 from which long flaps 22 and adjacent first holes 42 have been punched, and a second foil sheet 44 from which flaps 44 and adjacent second holes 46 have been punched, wherein the foil sheets 40, 44 are positioned so that their respective flaps will cover opposing holes with an overlap. This embodiment does not require the provision of the base plate 10, and solely the foil sheets 40 and 44 are used, the sheets having adhered thereto electrical conductors and optionally an electrically conductive outer layer, or may alternatively comprise foil sheets which are fully conductive electrically, such as resilient metal foil sheets. This is indicated in FIG. 6, in which the overlaying base plate 10 is shown in broken lines. A supporting frame 48 can be fitted around the edges of the foil sheets. Such punched foil sheets can also be used instead of the aluminium foil sheet on blister packs, which are then connected to a base unit 2. In this case, the blister pack may be the lone storage plate, although it may also be supported by a frame 48 and/or a base plate 10. In this case, electrical contacts may be provided solely on one side of the foil sheets 40, 44.

When taking the device into use, a medicament dose is placed in each of alveoli 301, 302, etc. As aforementioned, the medicament dose may consist in one or more pills or the like, and different alveoli may have different contents. Suitably, each row of alveoli will have mutually the same content. When filling the device, the long flap 22 is pressed down beneath the short flap 24 and the first electrical contact surfaces 26, 28 on respective lid flaps are brought into conductive connection with one another. At the same time, the base unit 2 registers in its memory that this space is full. The memory is supplied with data with regard to the content of the different alveoli and also with regard to the time at which the medicament shall be taken, this data being inserted externally, for instance through the medium of a keyboard or a conductor extending from a computer. The base unit 2 produces an alarm signal when it is time to take a medicament dose. The patient then presses-out the content of that alveolar which is next in turn, while pressing the long flap 22 up over the short flap 24 at the same time. This brings the second electrical contact surfaces 30, 32 into conductive connection with one another. An electric signal corresponding to the space 301, 302, etc. from which the medicament has been removed is sent through the conductor 34, the contact surfaces 30, 32 and back through the relevant conductor 201, 201, etc.. This provides an acknowledgement of the fact that the medicament has actually been taken. In the absence of such acknowledgement, the base unit 2 will produce a new alarm signal and may possibly be constructed to issue some other type of signal which indicates that something is wrong.

When the device includes different types of medicament, the base unit 2 will indicate the medicament that is to be taken next. This can be effected through the medium of text presented in the window 5 on the base unit 2, or through the medium of a marking adjacent the space 14 that is next in turn. Such marking may be effected with the aid of a light emitting diode, e.g. 401, or with the aid of an LCD-window adjacent the alveolar concerned and power can be supplied through the associated conductor 101.

The base unit 2 may be constructed in different ways, depending on the need in question; for instance a simple reminder to take medicine for relatively harmless symptoms and precise time-set medication programs which have significant importance to the well being of the patient. The central part is a data processing part 50, which may be a microprocessor or an electronic circuit.

Figure 7:
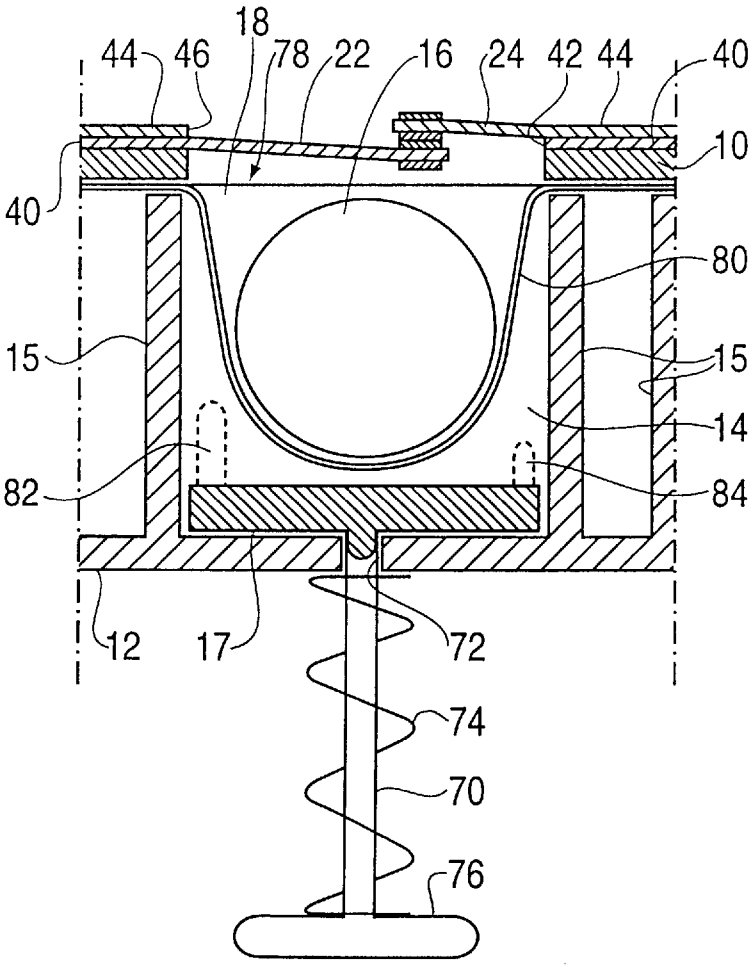
FIG. 7 is an enlarged part view of FIG. 3 according to a second embodiment.

FIG. 7 illustrates an alternative embodiment in which the spaces or cavities 14 are formed by a cell structure having fixed walls 15 which project up from a rigid bottom plate 12, and a movable bottom 17. The bottom 17 includes a press rod 70 which extends through a hole 72 in the plate 12 and terminates with a press knob or button 76 which is biased by a spring 74. Fitted above the cell structure is a removable or upwardly pivotal base plate 10 provided with flaps 22, 24. In the case of the illustrated embodiment, a blister pack 78 is placed in the space between the base plate 10 and the cell structure, wherein the blisters 80 containing respective medicament doses 16 project down through the opening 18 of respective spaces 14. The aluminium foil sheet on the blister package may be replaced with foil sheets 40, 44 provided with flaps 22, 24 and functioning as a lid. The package will then also preferably include a protective plastic sheet on the flap side thereof, or an outer bag.

Alternatively, the medicament dosage 16, i.e. one or more pills or the like, may lie loosely in the spaces 14. To ensure that even small pills will be discharged fully, the bottom plate 17 may advantageously include projections, shown in broken lines, which act on the flaps 22, 24, in the present case a long projection 82 for the long flap 22 and a short projection 84 for the short flap 24. The flaps will then switch places in the same way as when the space accommodates a pill or tablet which completely fills the opening.

Figure 9:
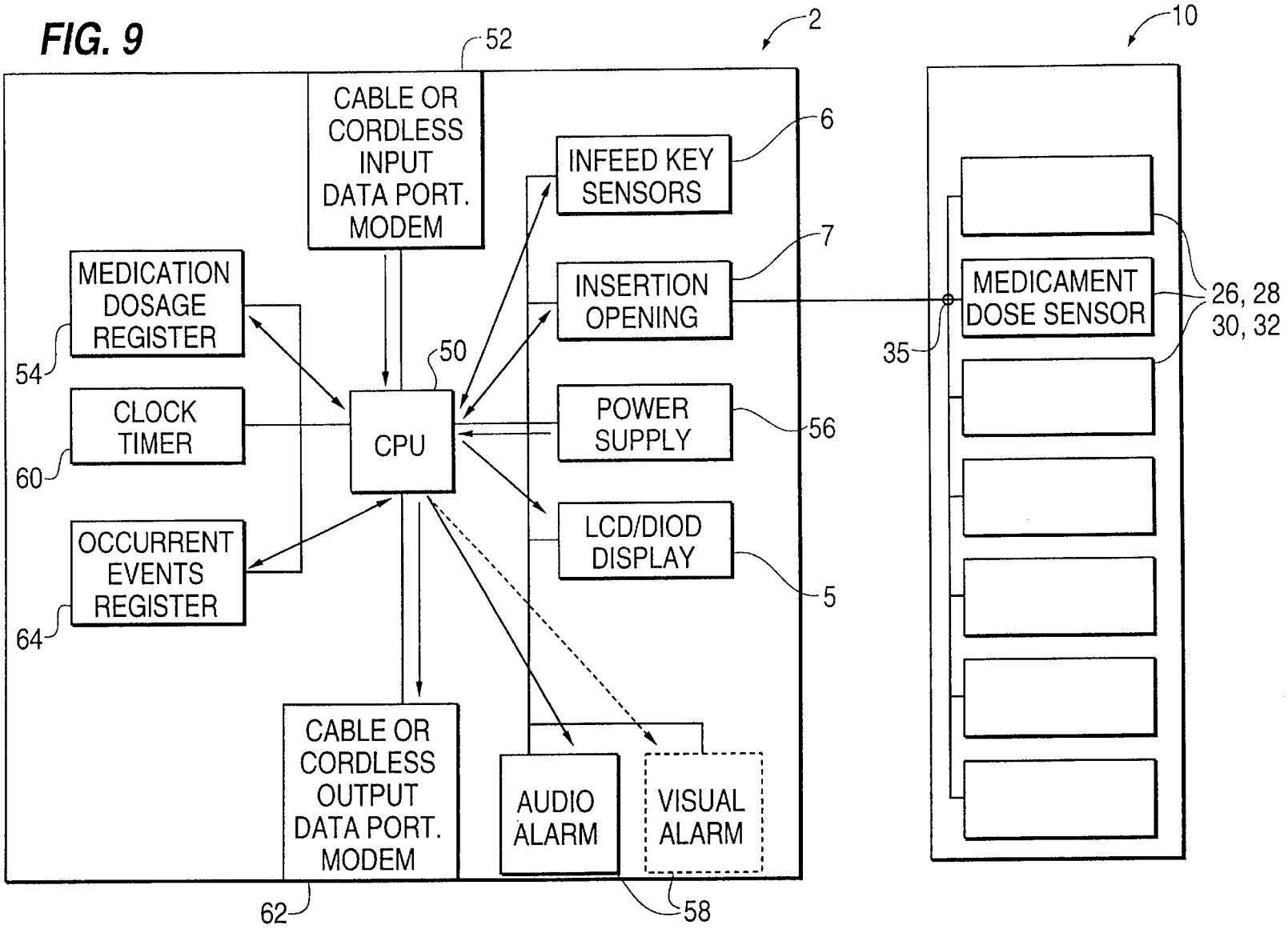
FIG. 9 is a block schematic which illustrates the function of the memory unit of the device.

FIG. 9 is a block schematic which illustrates a preferred base unit and also units and functions connected thereto. The core of the base unit is a microprocessor or the like having a CPU 50 which is connected to the input keys 6 and which is intended to receive, optionally through the medium of connections via cables or cordless input data ports with or without a modem 52, data from external sources. Some external sources include another computer or terminal, radio, a telecommunications network or satellite with regard to a medication plan, medication dosage, data concerning different medicaments in different spaces 301, 302 etc. The external sources can provide optional alternative medication plans and alarm times, etc., where the data is stored in a medication dosage register 54. Input data and/or occurrent events are shown in the light emitting diode window or LCD-window 5 of the base unit. The base unit also includes a battery or some other power supply 56, and an audio device and as optional visual alarm 58, and an electronic timer 60. The microprocessor is connected to respective storage spaces 301, 302 etc., by conductors 101, 102 etc. and conductors 201, 202 etc., in order to indicate the "inward" and "outward" state of each space or by scanning the spaces periodically with short current pulses. A further output signal conductor extends from the microprocessor to the LCD-window or light emitting diode window 5 or the light emitting diodes or LCD-windows 401, 402 etc. at respective spaces 301, 302 etc., to indicate which medication shall be taken next.

The base unit may also include its own data insertion means (infeed keys 6) or be connected to data insertion means, e.g. a keyboard, for inserting data relating to the state of the patient's health in a separate register intended for such data. This data may cause the microprocessor to calculate new, modified medication intervals and/or medication dosages. Finally, the base unit may include a register 64 for registering occurrent events, and an output communications port 62 optionally provided with a modem, which may be the same as the input port 52. The port may communicate with or without cables and is intended to deliver reports concerning the intake of medicaments and helth data to external registers or an external computer for remote monitoring of the patient and optionally for changing medication times and medicament dosages in the event of a medicament intake having been excluded. Such data can be used when clinically testing new medicines and for monitoring the course of serious illnesses, among other things.

It will be understood that the invention is not restricted to the illustrated and described exemplifying embodiments thereof, and that variations and modifications can be made within the scope of the inventive concept as defined in the following claims. For instance, the device may include solely the first electrical contacts 26, 28 or solely the second contacts 30, 32, wherein the memory unit 2 will understand an omitted signal as meaning that respective flaps are in the second position and that passage has occurred in an opposite direction. Furthermore, the flaps may be of any suitable kind, providing that they are resilient or springy. The flaps may have the form of elastic, springy (lid) flaps or tongues, or may also have the form of rigid flaps that are hinged by a springy hinge means.

I claim:

1. A medicament storage device which includes a storage plate for at least one quantity, for instance a medication dosage, stored in a storage space, characterized in that the opening of the storage space has a closure means which includes one long and one short mutually opposite resiliently mounted or elastic flap which overlap one another, wherein the flap overlap regions are provided with indicating means which indicate the direction of the latest passage through said opening, and/or detection means which produce a signal when passage occurs through the opening and indicates the direction of said passage.

2. The device according to claim 1, characterized in that the short flap has a first color marking and/or sign marking on the outer surface of its overlap region, said marking showing that the latest passage took place in a direction into the space; and in that the long flap has on the outer surface of its overlap region a second color marking and/or sign marking which indicate that the latest passage took place in a direction out of said space.

3. The device according to claim 1, characterized in that the long flap has on its upper surface a first electrical contact surface and that the short flap has on its undersurface a first electrical contact surface, said contact surfaces when in contact with one another producing a signal which indicates that the last passage took place in an inward direction; and/or in that the long flap has on its undersurface a second electrical contact surface and the short flap has on its upper surface a second contact surface, wherein the surfaces function to produce a signal which indicates that the last passage took place in an outward direction, when said second contact surfaces are in contact with one another.

4. The device according to claim 3, characterized in that the device includes or is connected to a base unit which includes memory and alarm-signal functions; and in that an electric conductor extends to all electrical contact surfaces on at least one side of either the long or the short flap across all spaces; and in that individual electric conductors extend from each of the second flaps from respective first contact surfaces and/or individual electric conductors extend from respective second contact surfaces to said base unit (2).

5. The device according to claim 1, characterized in that the device includes visible signal means, such as a light emitting diode window or an LCD-window (5) which is intended to show that space which is next in line, and/or that visual signal means are provided at each of the spaces, said means preferably being supplied with current through respective first conductors.

6. The device according to claim 1, characterized in that the device includes a base plate provided with holes; and in that across each hole there is arranged a long lid-flap or tongue and a short lid-flap or tongue, said tongues or flaps being spring mounted or made of an elastic material and overlapping one another; and/or in that the base plate has the form of a circuit board which includes electric conductors.

7. The device according to claim 1, characterized in that the device includes a first foil sheet in which long flaps have been punched, and a second foil sheet in which short flaps have been punched, wherein the foil sheets are disposed so that their respective flaps will cover respective holes with a mutually opposing overlap.

8. The device according to claim 1, characterized by a bottom plate which is mounted beneath the base plate and/or the foil sheets and which includes elastic depressions or alveoli which enclose spaces beneath each of said holes.

9. The device according to claim 1, characterized in that there is arranged beneath the base plate a rigid bottom plate which includes upstanding fixed walls and movable bottoms which are intended to be acted upon by transfer means such as to dispense a medicament dosage located in respective spaces, and/or in that said movable bottoms include means which are intended to act on the flaps when removing a medicament dosage in a manner to cause the overlapping regions of the flaps to change places, wherein indicating means indicate that a dosage has been removed from a respective space and/or produces a signal which gives the same indication.

10. The device according to claim 1, characterized in that the storage plate is surrounded by an at least partially removable protective casing or lid; and/or that a conventional blister pack or a blister pack provided with long and short flaps can be mounted beneath the base plate.

* * * * *